United States Patent [19]

Wildeman et al.

[11] 3,996,770

[45] Dec. 14, 1976

[54] STITCH BONDED FABRICS

[76] Inventors: Arno Edgar Wildeman, Aurel House, Blueberry Road, Bowdon, Altrincham, Chester County; David Brunnschweiler, 515 Preston New Road, Blackburn, Lancaster County; Keith Whalley, 5 Harewood Ave., Simonstone, near Burnley, Lancaster County, all of England

[22] Filed: Dec. 14, 1973

[21] Appl. No.: 424,779

[30] Foreign Application Priority Data

Dec. 16, 1972 United Kingdom ..... 58207/72

[52] U.S. Cl. ..... 66/85 A

[51] Int. Cl.[2] ..... D04B 23/06

[58] Field of Search ..... 66/85 A, 194, 190, 195; 19/106, 155, 80

[56] References Cited

UNITED STATES PATENTS

| | | | |
|---|---|---|---|
| 2,513,893 | 7/1950 | Ramdell | 19/155 |
| 3,139,650 | 7/1964 | Diesel | 19/80 X |
| 3,309,901 | 3/1967 | Danbel et al. | 66/85 A |
| 3,377,387 | 8/1967 | Owen | 28/4 |
| 3,377,821 | 4/1968 | Vajda et al. | 66/85 A |
| 3,538,552 | 11/1970 | Foley | 19/106 X |
| 3,540,098 | 11/1970 | Ploch et al. | 68/85 X |
| 3,616,124 | 10/1971 | Danhel et al. | 66/192 X |
| 3,769,815 | 11/1973 | Ploch et al. | 66/85 A |

FOREIGN PATENTS OR APPLICATIONS

| | | | |
|---|---|---|---|
| 900,056 | 11/1953 | Germany | 66/85 A |

*Primary Examiner*—Ronald Feldbaum
*Attorney, Agent, or Firm*—Oblon, Fisher, Spivak, McClelland & Maier

[57] ABSTRACT

A fleece fabric is produced by feeding a fiber web to a reciprocating compound needle row and extending the web fibers across the needle row. A reciprocatory, rotary brush or comb, or a pin bar is used to feed the fibers to the needle row. The conventional cross folder can be dispensed with, and the fabric is stronger than when the web fibers are orientated before they are fed to the needles. The fabric has a density between twice and 15 times that of the constituent web.

23 Claims, 3 Drawing Figures

STITCH BONDED FABRICS

This invention relates to fleece fabrics and methods and apparatus for their production by the consolidation of a constituent web or fleece by knitting stitch loops therein.

BACKGROUND TO THE INVENTION

Fabrics are made from fibrous fleeces (of which the fibres may be staple fibres or continuous filaments) in a variety of ways. An increasingly important proportion of fleece fabric production is made by knitting stitch loops in a fibre web or fleece so that the loops extend in seams lengthwise of the fabric. The seams are knitted by a row of compound needles which reciprocate to penetrate the fleece and draw the loops through to the rear surface.

It is required to have the fleece fibres orientated across the needle row in order that the individual fibres shall be engaged in stitch loops in laterally spaced seams, if the fabric is to have sufficient widthwise strength and dimensional stability. By orientation, in this context, is meant, of course, that the fibres are not necessarily absolutely straight and parallel to the needle row as they are presented to it, merely that a good proportion of them shall extend in directions parallel or inclined to the row-wise direction.

To this end, a carded web (which has lengthwise orientation) is cross folded into a fleece having several layers, the lengthwise direction of the cross folded fleece being the widthwise direction of the web as it comes from the card, so that the fibre orientation is now widthwise. This operation also has the effect of increasing the thickness of the fleece so that different weights of fabric may be produced by folding the web into fleeces of different thickness.

Such a widthwise orientated fleece may then be fed directly to the needle row, or it may first be rolled up and stored until required, then fed from the roll.

SUMMARY OF THE INVENTION

Although satisfactory fabrics can be produced in this way, the cross folder is an expensive machine, and from the fleece it produces, the needles can only grasp a relatively small proportion of the total number of fibres available. Thus so-called fleece knitted fabrics have tended to be relatively weak.

A relatively stronger fabric is produced according to the invention by extending the web fibres across the needle row as they are fed into the needle hooks.

In particular, this method enables the conventional cross folder to be dispensed with.

By laying the fibres into the needle hooks a greater proportion of the available fibres can be grasped by the needles to participate in the stitch loop formation, and correspondingly stronger fabrics can be produced. Because of the relative strength of the fabrics, lighter weight fabrics having adequate strength can be produced.

Any manner of web or fleece preparation may be used. For example, instead of a card, a pneumatic fleece layer may provide a randomly orientated fleece.

The fleece fibres may be fed to the needles by a member which extends them across the needle row. Such a member may reciprocate them across the needle row, and may rotate about an axis extending across the needle row.

The member may be a tined member, which is to say it may be a brush with bristles of natural or synthetic fibre or of flexible metal wire, or a comb, in which the tines are more rigid metal pins, or a pin bar, in which pins or bristles may execute an orbital motion.

The stroke of the member reciprocating across the needle row may be at least twice, but preferably less than 50 times the needle spacing. Usually, the needle gauge may be between two and 22 per inch (although finer gauges are increasingly being used.)

The duration of the stroke of the member may be more than one needle cycle, and if it is two or more needle cycles, the stroke of the member may be effected in discrete steps each equal in duration to one needle cycle, with a pause between the steps.

These methods tend to produce, from a fibre web having a given density (i.e. weight per unit area) a fleece fabric having a substantially higher density, and the invention comprises a method of producing a fleece fabric by knitting stitch loops in a fibre web, in which the knitted web density is at least twice that of the web before knitting. Fleece fabrics according to the invention may have a density up to 15 times or more the density of the web from which they were produced. With the simple chain stitch formation, it may be relatively easy to unravel the stitches and restore even a dense fleece fabric into a relatively fine fleece. This is not readily done with fleece fabrics produced from cross folded webs.

The invention also comprises apparatus for producing a fleece fabric comprising a needle row and means adapted to extend the fibres across the needle row as they are fed into the needle hooks.

The apparatus may comprise a member which feeds the fibres to the needles and extends them across the needle row, and the said member may be reciprocable across the needle row and may be rotatable about an axis extending across the needle row, and it may be a tined member such as a brush, comb or pin bar.

BRIEF DESCRIPTION OF THE DRAWINGS

Embodiments of methods and apparatus for producing a fleece fabric according to the invention will now be described with reference to the accompanying drawings, in which.

DESCRIPTION OF THE PREFERRED EMBODIMENTS

Figure 1:
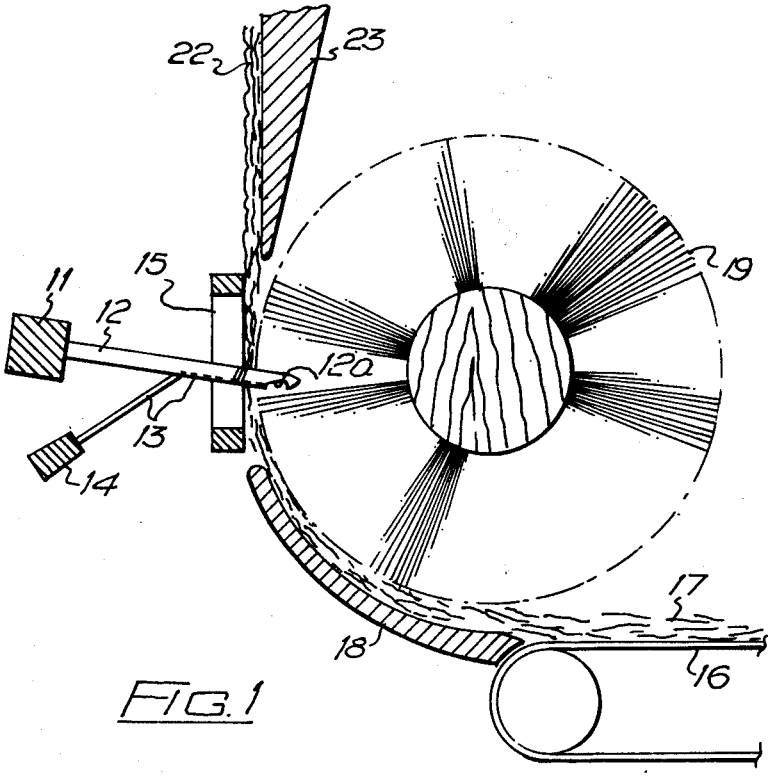
FIG. 1 is a cross section through a needle row of one embodiment of apparatus.
Figure 2:
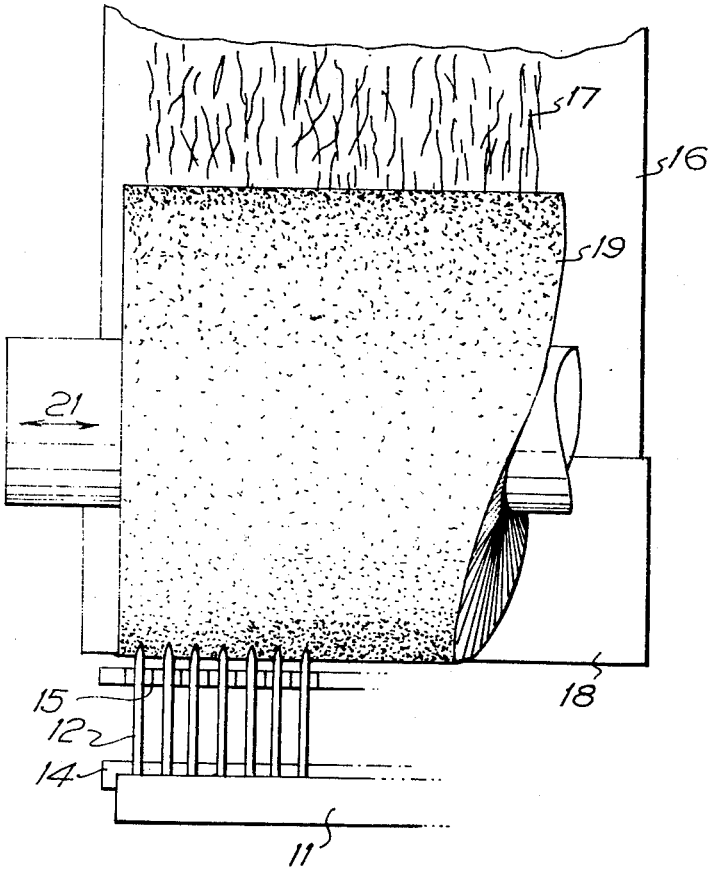
FIG. 2 is a plan view of the embodiment illustrated in FIG. 1.

FIGS. 1 and 2 illustrate a needle head comprising a reciprocatory bar 11 provided with a row of compound needles 12 of which the closing wires 13 are carried in a bar 14 which is reciprocated in synchronism with the needle bar 11 to close the needle hooks **12*a* of the needles 12 at the appropriate moment in the stitching cycle of the reciprocatory needles before they are withdrawn from the fleece, so that a loop already formed on the shank of each needle during the previous cycle is knocked over by the sinkers 15**.

Fibre is fed in a thin web from a card (not shown) to a fleece conveyor 16 which in turn feeds the thin web of fibres 17 into a trough 18 in which a rotary brush 19 picks up the fibres and carries them around to the needles 12. The conveyor 16 overfeeds the web 17 into the brush 19. By this action, the web or fleece is made thicker, so that by adjusting the rate of fibre feed by the conveyor 16 relative to the rate of rotation of the brush 19, any desired fabric weight may be selected.

The overfeeding action also tends to extend laterally the fibres which had been orientated lengthwise of the carded web, thereby introducing a measure of widthwise orientation. The brush 19, however, also has a reciprocatory motion along its axis, as shown by the arrow 21. This motion may have a stroke of at least twice the needle spacing and up to 50 times the needle spacing, in order to better spread the fibres across the needle row as they are fed to the needles. The action can have the effect that an end or mid-section of a fibre or group of fibres is caught in the open hook of one or more needles and the other end or ends then trail laterally so that they are laid into the open hooks of other needles before the closing wires close off the hooks.

The rate at which the brush 19 reciprocates in the arrow 21 direction is selected to be similar to the rate at which the needle bar 11 reciprocates to penetrate the needles 12 into the web. These rates may be relatively adjustable to vary the effect. In general, it may be sufficient to oscillate the brush 19 at a somewhat lower rate than the needle bar 11, for example one stroke of the brush for each complete stitching cycle of the needle bar 11. If the stroke is a long one, it may be desired to reduce the rate of reciprocation of the brush 19 still further. The brush could move for two or more needle cycles in one direction before moving back in the opposite direction at the same speed for the same time. The brush movements could be effected in steps, in timed relationship with the needle motion, so that the brush pauses in its lateral motion while the needles are retracted.

The fabric 22 is withdrawn from the needle head over a fabric support bar 23.

Figure 3:
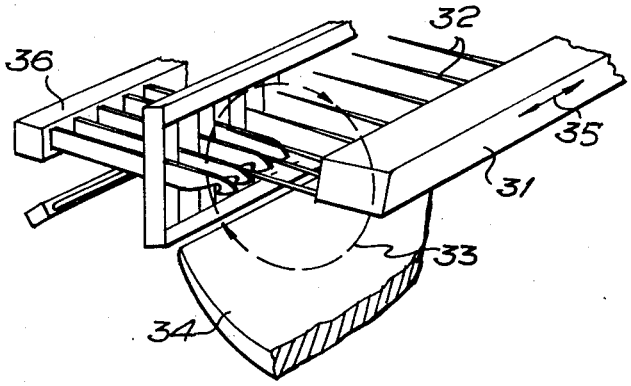
FIG. 3 is a perspective view of another embodiment.

FIG. 3 illustrates another embodiment of apparatus for producing a fleece fabric, in which the rotary brush is replaced by an orbital pin bar 31, the pins 32 of which move on the orbital path shown by the dashed line 33, gathering up fibre from the supply chute or trough 34. The pin bar also has an oscillatory motion across the needle row as shown by the arrow 35. These two motions can be in synchronism with the reciprocation of the needle bar 36.

A comb, in which the tines are rigid pins rather than relatively flexible natural or synthetic bristles or flexible wire, could be substituted for the brush 19 of FIGS. 1 and 2, and bristles could similarly be used instead of the ribid pins 32 on the bar 31 of FIG. 3.

The required oscillatory and rotary motions can be produced by known drives from a main drive shaft.

By virtue of the overfeed facility, it is possible to consolidate the fleece to a greater extent than hitherto possible, giving it more strength and covering power. A fleece fabric according to the invention may have up to 15 times the density of the fibre web from which it is knitted, as compared with fabrics produced according to prior art methods, in which the fabric density seldom exceeds one and one half times the fleece density, and so the initial web must be cross folded several times to achieve adequate fabric density. At the same time, because of the relative strength of the fabric according to the invention, a relatively lighter weight fabric can be produced. Very satisfactory fabrics have been produced in weights less than 100 grams per square metre.

Fabrics produced by the methods and apparatus described exhibit stitch loops on one face, and a more or less random fibrous appearance on the other face, with, however, ribs which can be made more or less pronounced according to the operating parameters (the stroke length of the brush or comb, the rate of reciprocation, the overfeed, and so on.)

Any type of fibre may be used in the preparation of the web or fleece, for example natural or man-made fibres, bicomponent fibres or blends of natural and synthetic or of different kinds of synthetic fibres.

The resulting fabrics may be further processed as by reinforcement by warp yarn stitch bonding or by thermobonding or by coating with a plastics material such as polyvinyl chloride.

We claim:

1. A method of producing a fleece fabric comprising the steps of:

a. feeding a fibre web to a reciprocating compound needle row, b. laterally moving said fibre web within the vicinity of said needle row so as to extend the web fibres across the needle row as they are fed thereto and thereby facilitate the formation of a stitched structure which has fibres of said web taking part in adjacent stitch rows and adjacent stitch courses whereby through interaction between said reciprocating needles and said fibres a consolidated fibre web or fabric is produced, and c. withdrawing said consolidated web or fabric from said needle row.

2. A method of producing a fleece fabric comprising the steps of:

a. causing a member to feed a fibre web to a reciprocating compound needle row, b. causing said member to be laterally moved so as to laterally move said fibre web within the vicinity of said needle row and thereby extend the web fibres across the needle row as they are fed thereto so as to facilitate the formation of a stitched structure which has fibres of said web taking part in adjacent rows and adjacent stitch courses whereby through interaction between said reciprocating needles and said fibres a consolidated fibre web or fabric is produced, and c. withdrawing said consolidated web or fabric from said needle row.

3. A method according to claim 2, wherein said member reciprocates across the needle row.

4. A method according to claim 2, wherein said member rotates about an axis extending across the needle row.

5. A method according to claim 2, wherein said member is a rotary brush.

6. A method according to claim 5, wherein said brush reciprocates across the needle row.

7. A method according to claim 2, wherein said member is a comb.

8. A method according to claim 2, wherein said member is a pin bar.

9. A method according to claim 2, wherein said member reciprocates across the needle row with a stroke having a length between one and 50 times the needle spacing.

10. A method according to claim 2, wherein said member reciprocates across the needle row with a stroke the duration of which is at least the duration of a needle knitting cycle.

11. A method according to claim 2, wherein said member reciprocates across the needle row with a stroke the duration of which is more than one knitting cycle, and the reciprocation is effected in steps with a pause while the needles are retracted.

12. Apparatus for producing a fleece fabric comprising:

a. a row of compound needles having hooks and closing wires and means to reciprocate said needles and their closing wires in a fleece knitting fashion, b. means for feeding a fibre web to said needle row, and c. laterally movable means for laterally moving said fibre web within the vicinity of said needle row so as to extend said fibres across the needle row as they are fed thereto, whereby as a result of the interaction between said reciprocating needles and said fibres, the formation of a stitched structure which has fibres of said web taking part in adjacent stitch rows and adjacent stitch courses produces a consolidated fibre web or fabric.

13. Apparatus for producing a fleece fabric comprising:

a. a row of compound needles having hooks and closing wires and means to reciprocate said needles and their closing wires in a fleece knitting fashion, and b. a member feeding a fibre web to said needle row and including laterally movable means for laterally moving said fibre web within the vicinity of said needle row so as to extend said fibres across the needle row as they are fed thereto;

whereby as a result of the interaction between said reciprocating needles and said fibres, the formation of a stitched structure which has fibres of said web taking part in adjacent stitch rows and adjacent stitch courses produces a consolidated fibre web or fabric.

14. Apparatus according to claim 13, in which said member is reciprocable across the needle row.

15. Apparatus according to claim 13, in which said member is rotatable about an axis extending across the needle row.

16. Apparatus according to claim 13, in which said member is a rotary brush.

17. Apparatus according to claim 13, in which said member is a comb.

18. Apparatus according to claim 13, in which said member is a pin bar.

19. Apparatus according to claim 13, in which said member is reciprocable relatively to the needles with a stroke length equal to between one and fifty times the needle spacing.

20. Apparatus according to claim 19, in which said stroke length is adjustable.

21. Apparatus according to claim 13, in which said member is reciprocable relatively to the needles with a stroke the duration of which is equal to at least one needle knitting cycle.

22. Apparatus according to claim 21, in which said stroke duration is adjustable.

23. Apparatus according to claim 13, in which said member is reciprocable relatively to the needles with a stroke the duration of which is equal to at least two knitting cycles, the reciprocation being effected in steps with a pause while the needles are retracted.

* * * * *